US010888731B2

(12) United States Patent
Olmstead et al.

(10) Patent No.: US 10,888,731 B2
(45) Date of Patent: Jan. 12, 2021

(54) SYSTEMS FOR GRIPPING AN EXERCISE BAR, ADJUSTABLE GRIP MOUNTS THEREOF, AND EXERCISE BARS INCORPORATING SUCH GRIP MOUNTS

(71) Applicant: Sound Temple Fitness LLC, Des Moines, IA (US)

(72) Inventors: Rocky Olmstead, Whittemore, IA (US); Benjamin J. Weninger, Des Moines, IA (US)

(73) Assignee: Sound Temple Fitness LLC, Des Moines, IA (US)

( * ) Notice: Subject to any disclaimer, the term of this patent is extended or adjusted under 35 U.S.C. 154(b) by 11 days.

(21) Appl. No.: 16/298,612

(22) Filed: Mar. 11, 2019

(65) Prior Publication Data

US 2020/0289870 A1 Sep. 17, 2020

(51) Int. Cl.
*A63B 21/072* (2006.01)
*A63B 23/035* (2006.01)

(52) U.S. Cl.
CPC ..... *A63B 21/0724* (2013.01); *A63B 21/0722* (2015.10); *A63B 23/03525* (2013.01); *A63B 2225/09* (2013.01)

(58) Field of Classification Search
CPC ..... A63B 21/072; A63B 21/0722; A63B 21/0724; A63B 21/0726; A63B 23/03525; A63B 2225/09
See application file for complete search history.

(56) References Cited

U.S. PATENT DOCUMENTS 4,585,229 A * 4/1986 Brasher ..... A63B 21/0724 482/106
4,618,142 A * 10/1986 Joseph, Jr. ..... A63B 5/20 482/106
4,743,018 A * 5/1988 Eckler ..... A63B 21/0724 482/106
4,822,035 A * 4/1989 Jennings ..... A63B 21/0724 482/106
5,152,731 A * 10/1992 Troutman ..... A63B 21/0724 482/106
5,211,616 A 5/1993 Riley, Jr.
5,334,113 A 8/1994 Roepke
6,022,300 A 2/2000 Hightower
7,056,268 B2 * 6/2006 Emick ..... A63B 21/0724 482/106
7,862,486 B1 1/2011 Watson
8,951,170 B1 * 2/2015 Tayo ..... A63B 21/0724 482/107
9,254,408 B1 * 2/2016 Otto ..... A63B 21/055
9,833,654 B1 * 12/2017 Gant ..... A63B 21/4035

* cited by examiner

*Primary Examiner* — Joshua Lee
(74) *Attorney, Agent, or Firm* — Armstrong Teasdale LLP

(57) ABSTRACT

Systems for gripping an exercise bar, adjustable grip mounts thereof and exercise bars that incorporate such adjustable grip mounts are disclosed. In some embodiments, the adjustable grip mount includes a handle which is rotationally and axially adjustable relative to the exercise bar. The adjustable grip mount may include locking members are adjustable between a locked position in which the adjustable grip mount is fixed in position on the exercise bar and an unlocked position in which the handle rotate and move axially along the exercise bar.

11 Claims, 21 Drawing Sheets

SYSTEMS FOR GRIPPING AN EXERCISE BAR, ADJUSTABLE GRIP MOUNTS THEREOF, AND EXERCISE BARS INCORPORATING SUCH GRIP MOUNTS

FIELD OF THE DISCLOSURE

The present disclosure relates generally to systems for gripping an exercise bar, adjustable grip mounts thereof and exercise bars that incorporate such adjustable grip mounts. In some embodiments, the adjustable grip mount includes a handle which is rotationally and axially adjustable relative to the exercise bar.

BACKGROUND OF THE DISCLOSURE

During some weightlifting exercises, grip placement and wrist orientation relative to the weights affects the biomechanics of a lifter and may affect the functional outcomes of these exercises. Some gripping placements and wrist orientations may cause unnecessary strain on muscle and joints. Poor gripping form may increase the risk of injury to the lifter, especially during heavy lifting activities or lifting performed during rehabilitation.

At least some known barbells include a center shaft and loading members at the both ends to which a lifter may selectively add weights to the barbell. The center shaft is sized and shaped to be grasped by the hands of the lifter during a weightlifting exercise. The center shaft may include one of a straight rod or a rod with slight bends at specific locations, providing the lifter only a few grasping positions. In these barbells, the gripping hands of a lifter may only be placed such that the medial-lateral axis of the hands and wrists are substantially parallel to the long axis of the barbell.

There is a need for weight lifting systems which enable a user to selectively grip the barbell in multiple positions and orientations relative to the loaded weight.

SUMMARY

One aspect of the present disclosure is directed to an exercise bar having a longitudinal axis. The exercise bar includes a pair of loading members. A rail is disposed between the loading members. The rail includes a slot formed therein that extends along at least a portion of a length of the rail. The exercise bar includes an adjustable grip mount for gripping the exercise bar. The adjustable grip mount includes a handle member that includes a handle for grasping the adjustable grip mount. The adjustable grip mount includes a locking member that extends through the slot and connects to the handle member. The locking member is configured to move between a locked position in which the handle member is clamped to the rail and an unlocked position in which the handle member may move along the rail relative to the longitudinal axis and in which the handle may rotate about a rotational axis.

Yet another aspect of the present disclosure is directed to an adjustable grip mount for gripping an exercise bar having a longitudinal axis. The adjustable grip mount includes a base that forms a base chamber for receiving at least a portion of the exercise bar. The adjustable grip mount includes a handle member configured to rotate relative to the base. The handle member includes a handle for grasping the adjustable grip mount. The handle member has a contact surface for contacting at least a portion of the exercise bar. The adjustable grip mount includes a locking member that enables the base and handle member to move relative to each other upon actuation of the locking member. The base and handle member are configured to move between a locked position in which the exercise bar is clamped to the base and/or the handle member and an unlocked position in which the handle member may move along the exercise bar relative to the longitudinal axis and in which the handle may rotate relative to the base.

Yet a further aspect of the present disclosure is directed to a system for gripping an exercise bar having a longitudinal axis. The system includes a first adjustable grip mount for gripping the exercise bar. The first adjustable grip mount includes a first handle member that includes a first handle for grasping the adjustable grip mount. The first handle has a first rotational axis. The first adjustable grip mount includes a first locking member that is movable between a locked position in which the first adjustable grip is fixed relative to the longitudinal axis and the first handle is fixed relative to the rotational axis and an unlocked position in which at least a portion of the first adjustable grip is movable relative to the longitudinal axis and in which the first handle may rotate about the first rotational axis. The system includes a second adjustable grip mount for gripping the exercise bar. The second adjustable grip mount includes a second handle member that includes a second handle for grasping the adjustable grip mount. The second handle has a second rotational axis. The second adjustable grip mount includes a second locking member that is movable between a locked position in which the second adjustable grip is fixed relative to the longitudinal axis and the second handle is fixed relative to the rotational axis and an unlocked position in which at least a portion of the second adjustable grip is movable relative to the longitudinal axis and in which the second handle may rotate about the second rotational axis.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BREIF DESCRIPTION OF THE DRAWINGS

Corresponding reference characters indicate corresponding parts throughout the drawings.

DETAILED DESCRIPTION OF THE DRAWINGS

The present disclosure relates to embodiments of an adjustable grip mount for gripping an exercise bar and exercise bars that incorporate one or more of the adjustable grip mounts. In some embodiments, the adjustable grip mount may be retrofitted to an exercise bar such that a handle of the adjustable grip mount is rotatable relative to the longitudinal axis of the exercise bar and is axially movable along the exercise bar. In some embodiments, an exercise bar includes one or more rails, such that a handle may move axially along the rails. The handle may also be rotatable relative to the longitudinal axis of the exercise bar. The adjustable grip mount of embodiments of the present disclosure may be part of a system for gripping an exercise bar. The system may include a pair of adjustable grip mounts for gripping the exercise bar with each hand.

Figure 1:
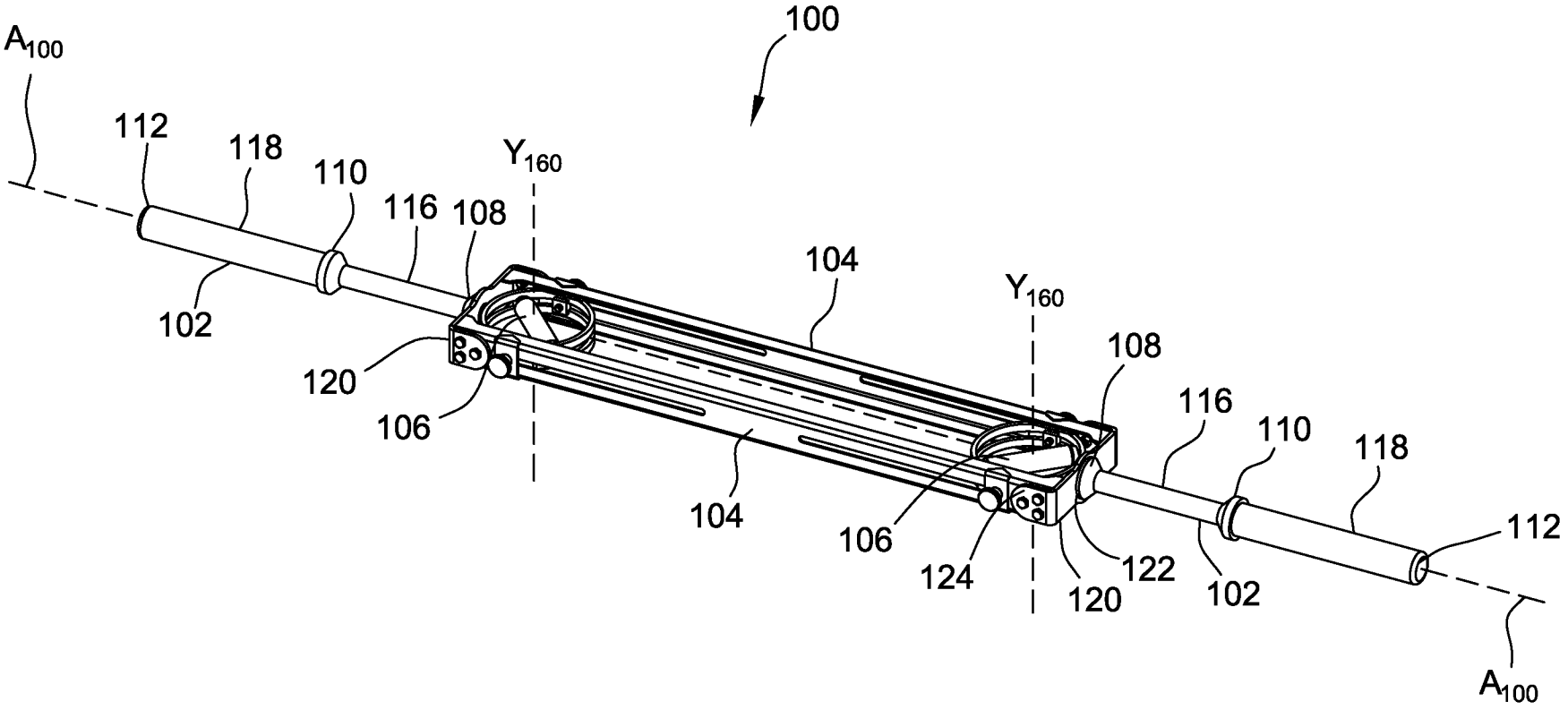
FIG. 1 is a perspective view of an embodiment of an exercise bar.

An example exercise bar of the present disclosure is indicated generally as "100" in FIG. 1. As used herein, the term "exercise bar" should generally be construed broadly to include any apparatus which can be used to lift or pull weights, including and without limitation, barbells, weight bars, weightlifting bars, rowing pull bars, pullup bars, and pull down bars, and the like.

Figure 2:
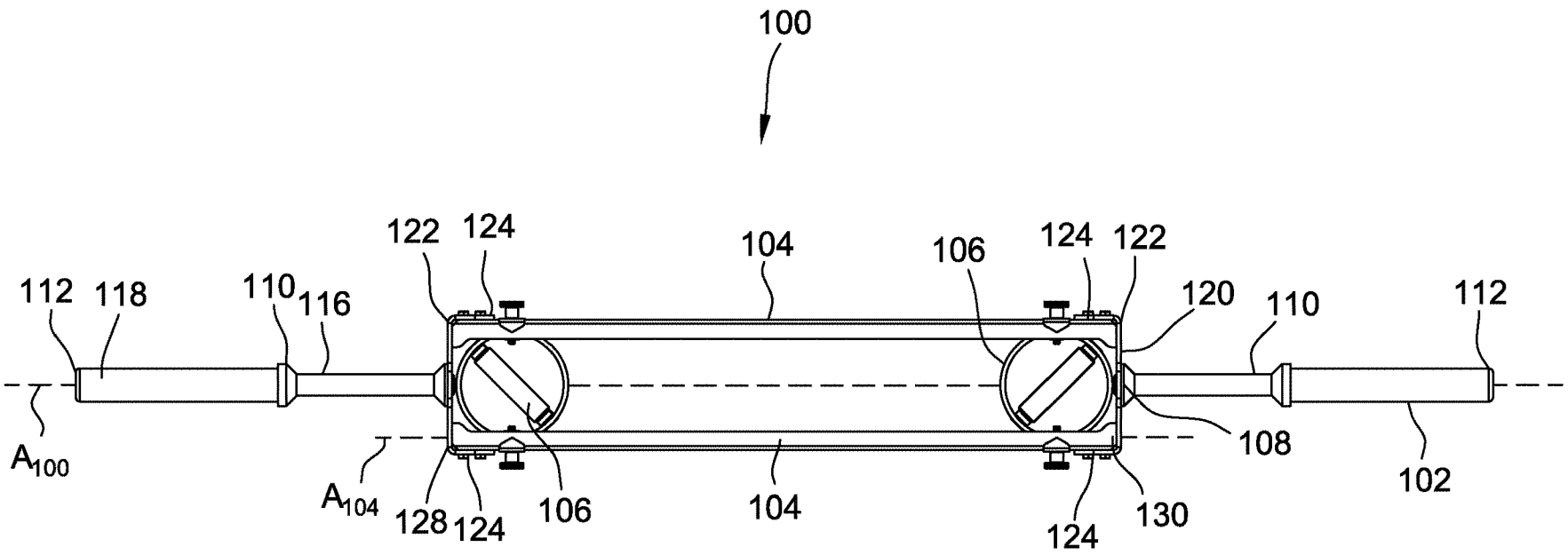
FIG. 2 is a top view of the exercise bar.
Figure 3:
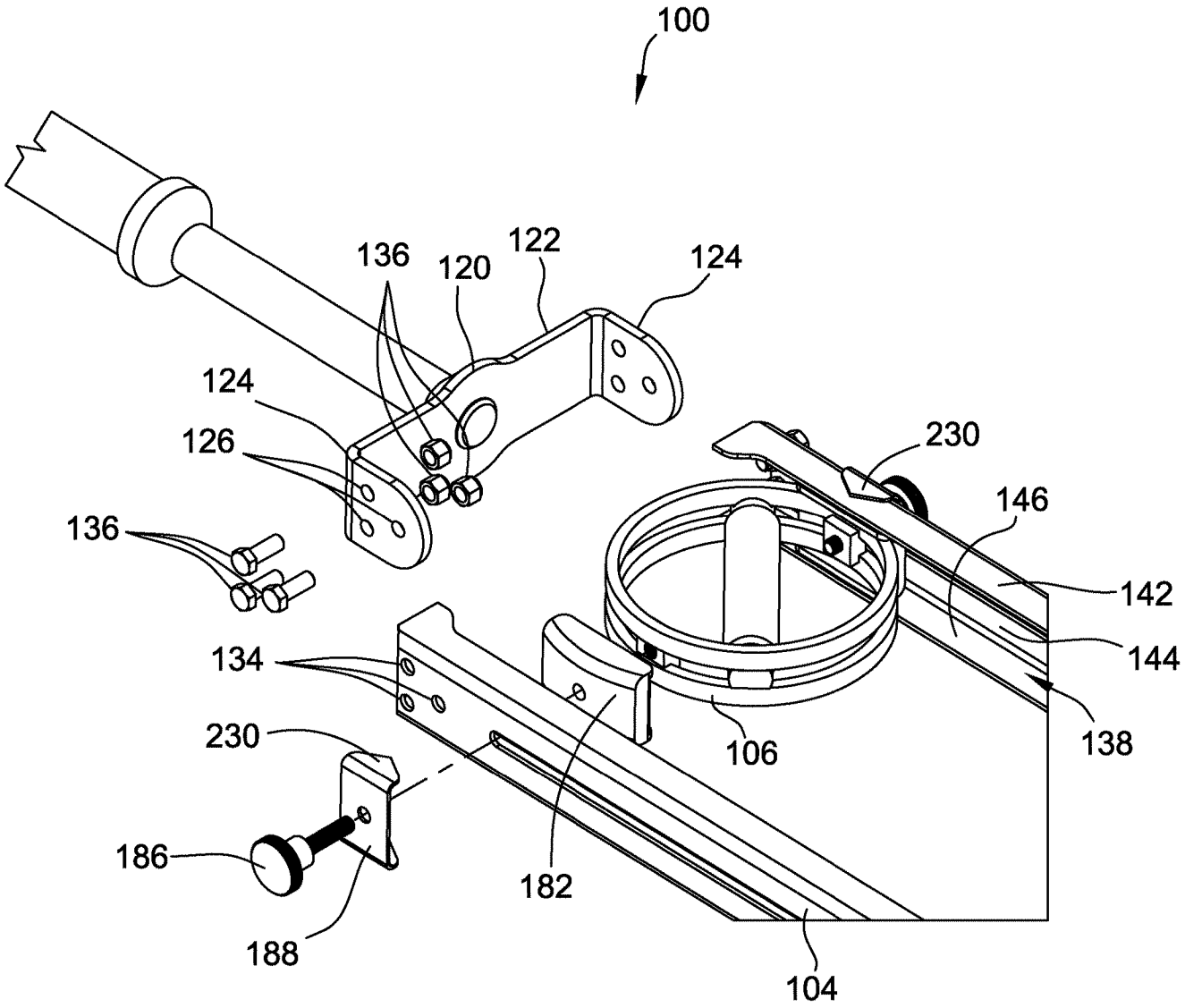
FIG. 3 is a perspective detailed exploded view of the exercise bar.

Referring now to FIGS. 1-3, the exercise bar 100 includes a pair of loading members 102, a rail 104 disposed between the loading members 102, and a pair of adjustable grip mounts 106 for gripping the exercise bar 100. The pair of loading members 102 each includes a loading member inner end 108 and a loading member outer end 112. The exercise bar 100 includes an exercise bar longitudinal axis $A_{100}$ extending between the loading member outer ends 112. Each of the loading members 102 includes an inner portion 116 and an outer portion 118. The loading members 102 include a collar 110 disposed between the inner portion 116 and the outer portion 118. The inner and outer portions 116, 118, and the collar 110 are substantially cylindrical in shape. In the illustrated embodiment, the outer portion 118 of the loading member 102 has a diameter larger than the diameter of the inner portion 116. The collar 110 has a diameter larger than the diameter of the outer portion 118. The collar 110 may act as a stop for barbell weights (not shown) that are loaded on the loading member 102 by a user to selectively adjust the amount of weight carried by the exercise bar 100. The illustrated loading members 102 are example loading members and generally any arrangement of loading members 102 that are capable of providing weight to the exercise bar 100 may be used unless stated otherwise (including embodiments in which the bar 100 itself is used for training or therapy without weights being added thereto).

The exercise bar 100 further includes a pair of loading brackets 120 mounted to each of the inner portions 116 of the loading members 102 at the loading member inner end 108. Each bracket 120 includes a first plate 122 (FIG. 3) perpendicular to the exercise bar longitudinal axis $A_{100}$ and includes a pair of second plates 124 that extend from the first plate 122. Generally, the bracket 120 and the loading member 102 may be connected in any manner that enables the exercise bar 100 to function as described herein. In the illustrated embodiment, the first plate 122 is welded to the inner portion 116 of the loading member 102. The second plates 124 extend perpendicular to the first plate 122 and are substantially parallel to the exercise bar longitudinal axis $A_{100}$. At least one bracket borehole 126 extends through the second plate 124.

Figure 4:
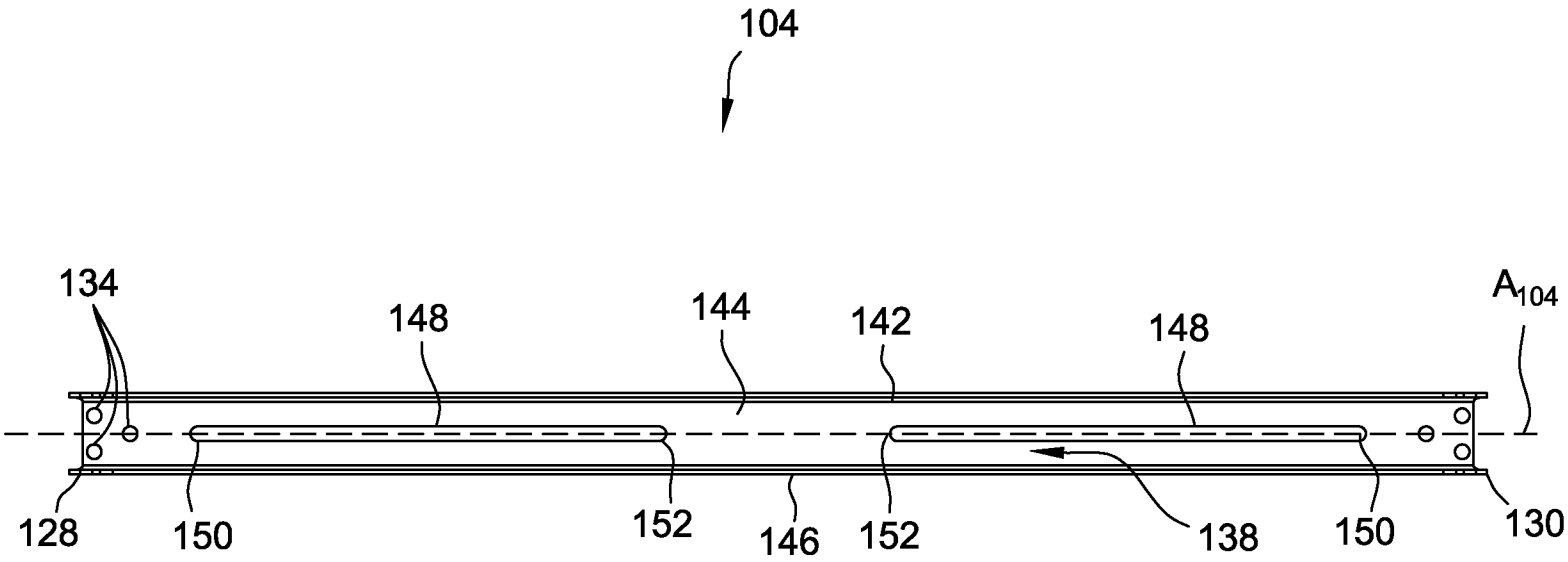
FIG. 4 is a side view of a rail of the exercise bar.

In the illustrated embodiment, the exercise bar 100 includes a pair of rails 104 opposite each other (which may be referred to herein as first and second rails). In other embodiments, the exercise bar 100 includes a single rail. Referring now to FIG. 4, each rail 104 includes a first rail end 128 and a second rail end 130. A rail axis $A_{104}$ extends from the first rail end 128 to the second rail end 130. The rail axis $A_{104}$ is substantially parallel to the exercise bar longitudinal axis $A_{100}$ (FIG. 1). The rail 104 is mounted between the pair of loading members 102 and rigidly fixed to the brackets 120 toward the first rail end 128 and the second rail end 130. The rail 104 may be fixed to the loading members 102 in any manner that enables the exercise bar 100 to function as described herein. In the illustrated embodiment, the rail 104 includes a plurality of rail boreholes 134 that align with the bracket boreholes 126 (FIG. 3) such that a bolt and nut 136 may be used to fix the rail 104 to the bracket 120. Alternatively, the rail 104 may be welded to the bracket 120 or the rail 104 and bracket 120 may be cast as a single component.

The rail 104 defines a rail channel 138 (FIG. 3) that extends along at least a portion of the rail 104 between the first rail end 128 (FIG. 2) and the second rail end 130. In the illustrated embodiment, the rail channel 138 extends along the entire length of the rail 104. In other embodiments, the rail channel 138 extends along a partial length of the rail 104. The rail 104 includes a top wall 142, a side wall 144, and a base wall 146 that define the rail channel 138.

Each rail 104 further includes at least one slot 148 (FIG. 4) defined on at least a portion of the side wall 144. The slot 148 includes a first slot end 150 and a second slot end 152. In the illustrated embodiment, each rail 104 includes two slots 148 formed in the side wall 144 along which the adjustable grip mounts 106 (FIG. 1) may be positioned. In other embodiments, the rail 104 includes a single slot 148 that extends over at least a portion of the length of the rail 104.

Referring now to FIGS. 5-8, the adjustable grip mount 106 includes a handle member 156 and a locking member 158. The handle member 156 includes a handle 160 and an annular member 162. The handle 160 includes a handle first end 164 and a handle second end 166 and a handle lengthwise axis $X_{160}$ extending between the handle first end 164 and the handle second end 166. The handle 160 is substantially cylindrical in shape and sized to be grasped by the hands of a user. The handle member 156 further includes a pair of handle brackets 170 that extend from the handle first end 164 and the handle second end 166.

The annular member 162 is substantially cylindrical in shape and includes an inner surface 172 and an outer surface 174. The annular member 162 includes a first ring 176 and a second ring 178. The first ring 176 and the second ring 178 are substantially parallel and separated by a distance such that the first ring 176 and the second ring 178 define the boundary of an annular raceway 180. The handle 160 is mounted to the annular member 162 in any manner which enables the exercise bar 100 to function as described herein. In the illustrated embodiment, the pair of handle brackets 170 that extend from the handle 160 are connected to the first ring 176 and the second ring 178. For example, the brackets 170 may extend into the annular raceway 180 (FIG. 5) and may be connected to the first and second rings 176, 178 using a welding connection.

Each adjustable grip mount 106 includes one or more locking members 158 and may include two locking members 158 opposite from each other as shown in the illustrated embodiments. Each locking member 158 includes a slide member 182, a lock nut 184, a thumb screw 186, and an alignment marker 188. The lock nut 184 includes a base 190 and a projection 192 that extends from the base 190 and extends into the annular raceway 180. The projection 192 is configured to be moveable within the raceway 180 and relative to the first and second rings 176, 178. The base 192 is positioned on the inner surface 172 of the annular member 162. The base 192 contacts the inner surface 172 of the annular member 162 when the locking member 158 is in its locked position as further described below. The lock nut 184 includes a threaded borehole 194 passing through at least a portion of the lock nut 184.

The slide member 182 is sized and shaped to be mounted within the rail channel 138 (FIG. 4) such that at least a portion of the slide member 182 and a portion of the rail channel 138 are in sliding contact. The slide member 182 defines a slide channel 204. The slide channel 204 is sized and shaped such that at least a portion of the annular member 162 is disposed within the slide channel 204 and the slide member 182 contacts the outer surface 174 of the annular member 162 when the locking member 158 is the locked position (i.e., a channel back surface 208 contacts at least a portion of the outer surface 174 of the annular member 162). The channel back surface 208 may be substantially concave in shape.

Figure 6:
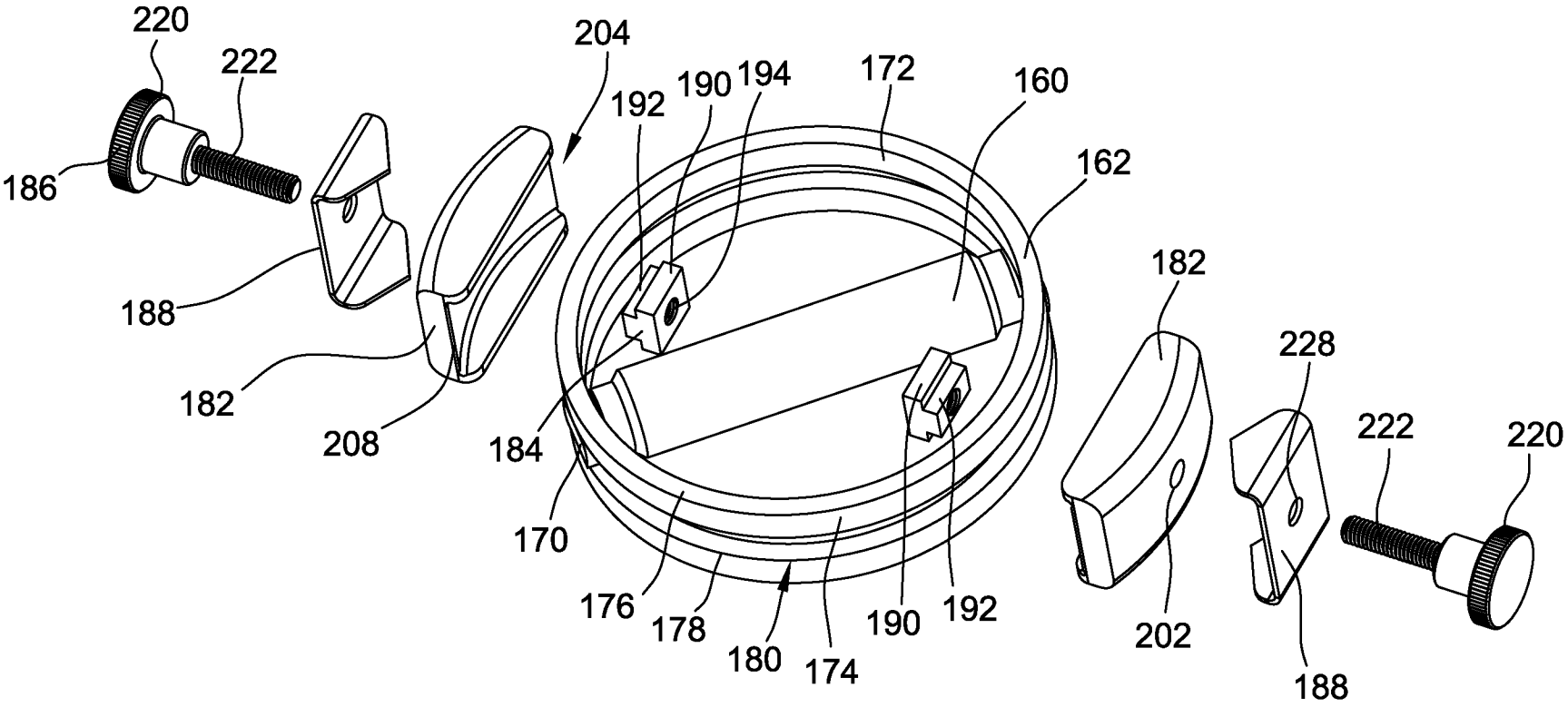
FIG. 6 is a perspective exploded view of the adjustable grip mount.
Figure 7:
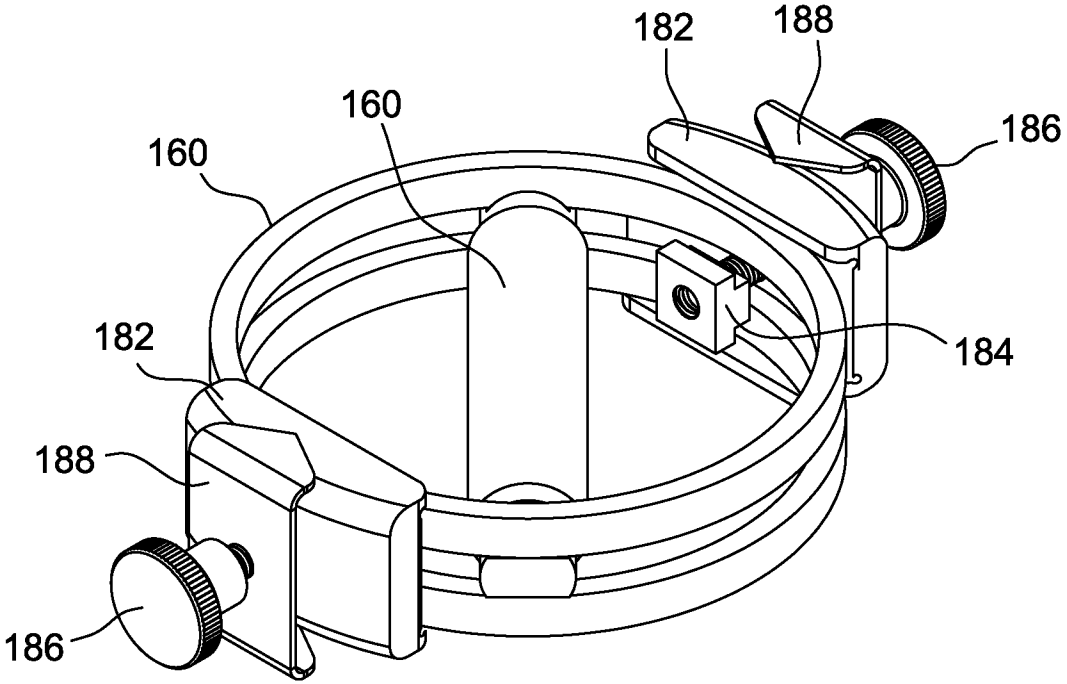
FIG. 7 is a perspective view of the adjustable grip mount in the unlocked position.
Figure 8:
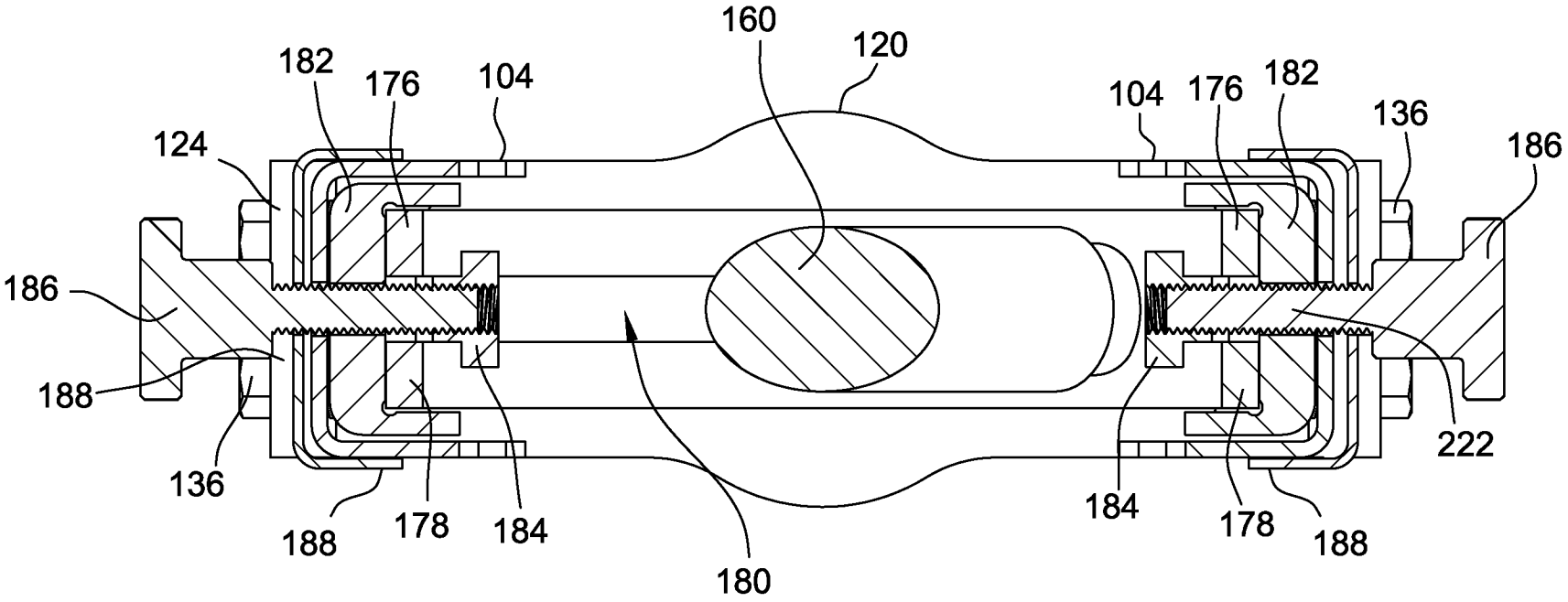
FIG. 8 is a cross-section view of the adjustable grip mount in the unlocked position.

The slide member 182 further includes a slide borehole 202 (FIG. 6). The slide borehole 202 is arranged such that, when the slide member 182 is mounted to the annular member 162 and disposed within the rail channel 138, the threaded borehole 194, the annular raceway 180, the slot 148, and the slide borehole 202 are aligned, such that there is an unobstructed opening passing through the rail 104, the slide member 182, and the threaded borehole 194.

The thumb screw 186 may include a knob 220 and a threaded shaft 222. The threads are sized and shaped to mate with the threaded borehole 194 of the lock nut 184. The knob 220 may be grasped by the hands of a user, such that a user may rotate the thumb screw 186. The thumb screw 186 is sized and shaped such that at least a portion of the thumb screw 186 passes through the slot 148 and the slide borehole 202 and may be selectively threaded into the lock nut 184.

Figure 5:
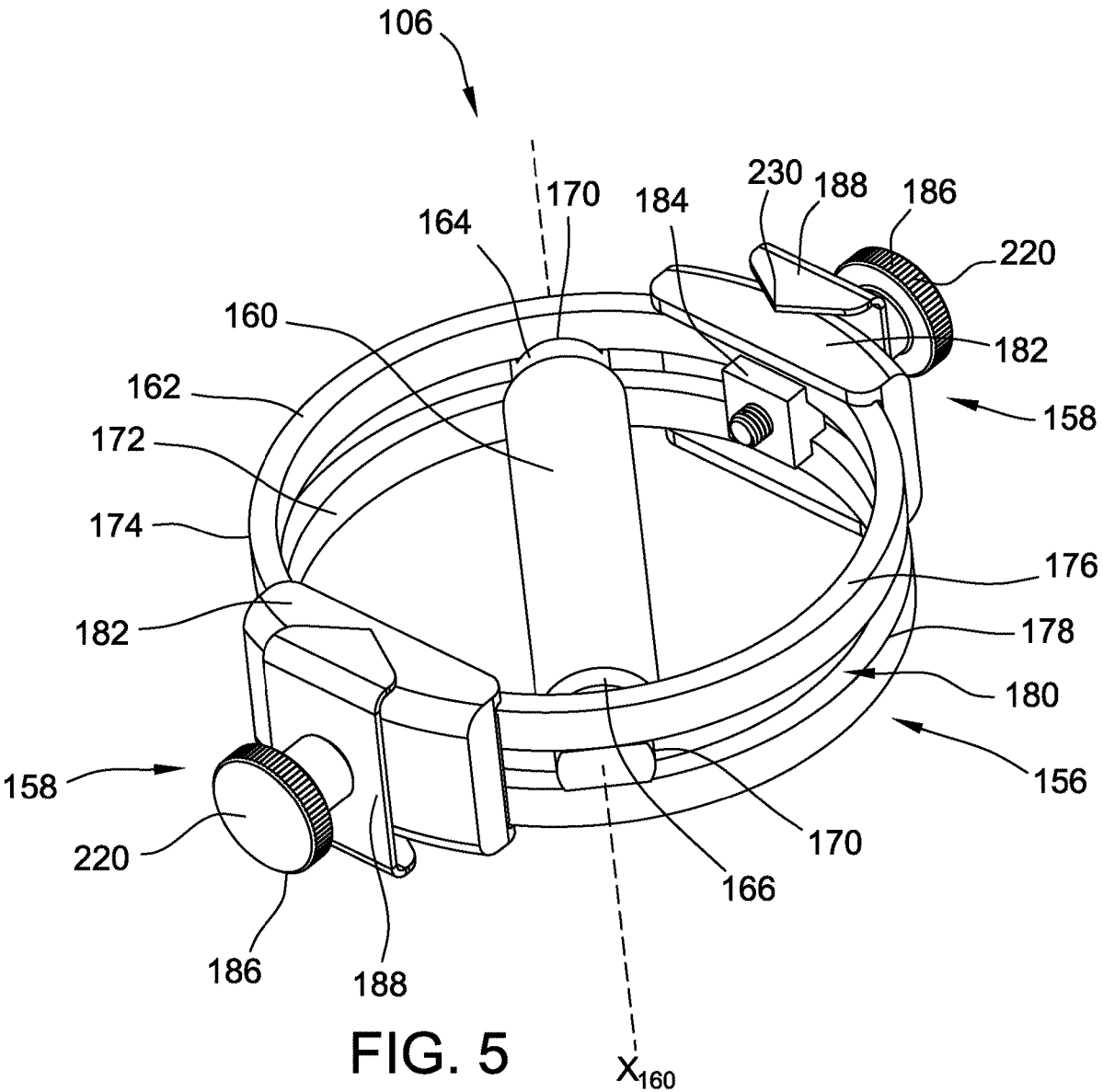
FIG. 5 is a perspective view of an adjustable grip mount of the exercise bar in a locked position.
Figure 9:
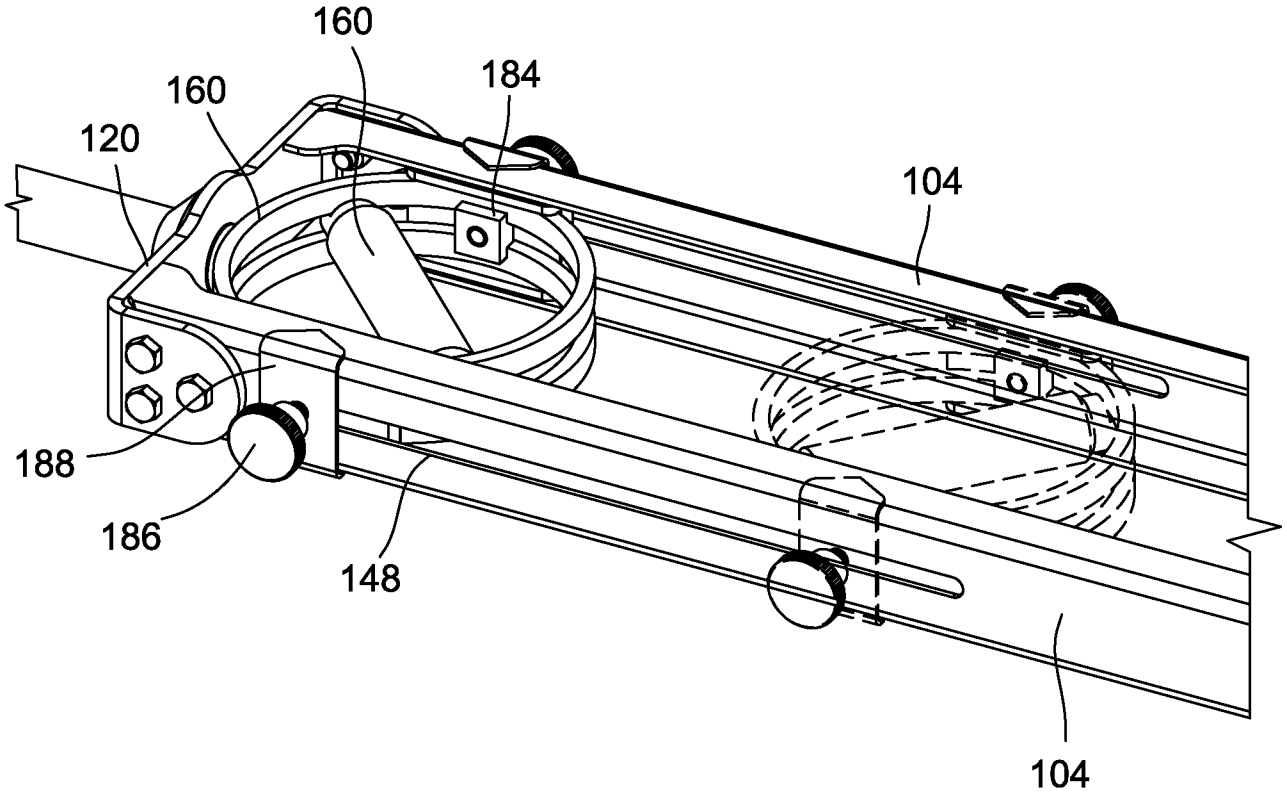
FIG. 9 is a perspective view of the exercise bar with the adjustable grip mount shown in two different positions relative to the rail.
Figure 10:
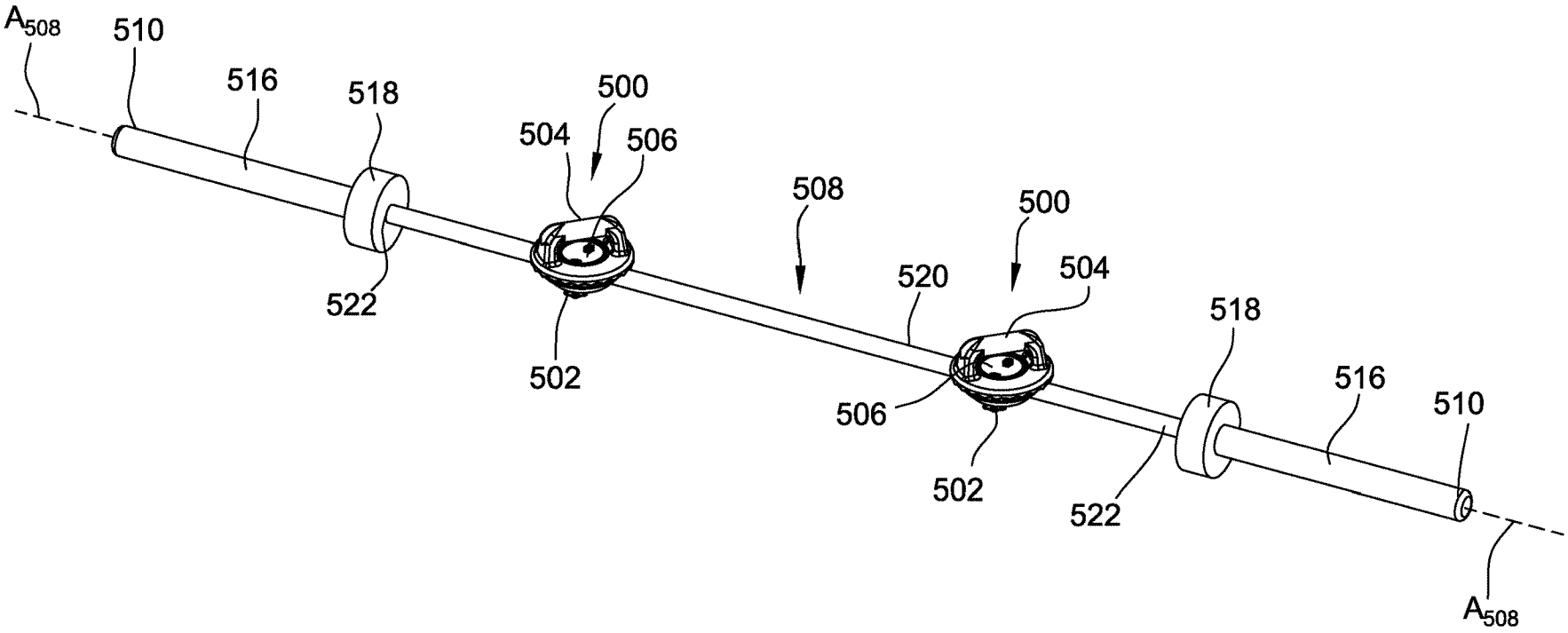
FIG. 10 is a perspective view of a pair of adjustable grip mounts of another embodiment connected to an exercise bar.

Each locking member 158 is configured to move between at least two positions—a locked position (FIG. 5) in which the handle member 156 is clamped to the rail 104 and an unlocked position (FIG. 7) in which the handle member 156 may move along the rail 104 relative to the longitudinal axis $A_{100}$ of the exercise bar 100 (i.e., there is clearance between the sliding member 182 and rail 104 to allow the sliding member 182 to move relative to the rail 104 as shown in FIG. 9). In the illustrated embodiments, the handle 160 is also capable of rotating about a rotational axis $Y_{160}$ (FIG. 1) when the locking member 158 is in the unlocked position (FIG. 5). In the unlocked position, the thumb screw 186 is only partially threaded with the lock nut 184, such that there is clearance between the adjustable grip mount 106 and the rail 104 to allow the adjustable grip mount 106 to move axially along the rail 104 and to allow the handle 160 to rotate about the rotational axis $Y_{160}$. In embodiments in which the adjustable grip mount 106 includes a pair of locking members 158 such as the illustrated adjustable grip mount 106 which includes two locking members 158 that each engage with a corresponding rail 104, both locking members 158 should be moved to the unlocked position to enable the adjustable grip mount 106 to be moved axially or to enable the handle 160 to rotate.

In the unlocked position of the locking member 158, the handle member 156 is moveable (e.g., may slide) relative to the slide member 182 such that the handle member 156 may be rotated relative to the slide member 182 (FIG. 9). A user may grasp the handle 160 and apply a torque causing the handle 160 to rotate about the rotational axis $Y_{160}$ (i.e., to change the angle formed between the handle lengthwise axis $X_{160}$ and the longitudinal axis $A_{100}$ of the exercise bar 100). The user may rotate the handle 160 about its rotational axis $Y_{160}$ to selectively position the lengthwise handle axis $X_{160}$ in a plurality of angles (e.g., at any angle) relative to the exercise bar longitudinal axis $A_{100}$. Additionally, in the unlocked position of the locking member 158, the slide member 182 is moveable within the rail channel 138 such that a user may selectively translate the slide member 182 and handle member 156 along the rail axis $A_{104}$ (FIG. 9). The user may grasp both the handle 160 and apply a push or a pull directed substantially along the rail axis $A_{104}$ to translate the position of the handle member 156 relative to the rail 104. The user may arrange the handle 160 in a plurality of positions (e.g., any position) relative to the rail 104. The unlocked position retains the alignment of the handle member 156, the sliding member 182, the locking nut 184, and the rail 104 to prevent complete disassembly of the exercise bar 100 while allowing sufficient clearance such that a user may adjust the position of the handle 160 relative to the rail 104.

To move the locking member 158 to the locked position (FIG. 5), the thumb screw 186 may be tightened within the lock nut 184 such that the thumb screw 186 and the lock nut 184 apply a clamping force to the adjustable grip mount 106 and the rail 104, thereby locking the position of the adjustable grip mount 106 relative to the rail 104 and preventing further rotation or translation of the handle member 156. A user may selectively position the exercise bar 100 in the locked and unlocked position by applying a force to the thumb screw 186 in order to either tighten the thumb screw 186 relative to the lock nut 184 or loosen the thumb screw 186 relative to the lock nut 184.

In the illustrated embodiment, one or more of the locking members 158 includes an alignment marker 188. The alignment marker 188 includes a borehole 228 (FIG. 6) through which the thumb screw 186 passes. The alignment marker 188 is fixed to the thumb screw 186 such that translation of the thumb screw 186 relative to the rail 104 causes translation of the alignment marker 188 relative to the rail 104. The alignment marker 188 is distanced from the rail 104 such that the alignment marker 188 does not obstruct translation of the adjustable grip mount 106. The alignment marker 188 may include a pointed portion 230. The top wall 142 (FIG. 3) of the rail 104 may include a ruler (not shown) defining incremental measures of distance. A user may visually inspect the pointed portion 230 relative to the ruler to selectively align the adjustable grip mount 106 relative to rails 104 (e.g., to position two adjustable grip mounts the same distance from the midpoint of the exercise bar 100). In other embodiments, the exercise bar 100 does not include an alignment marker.

The illustrated exercise bar 100 includes two adjustable grip mounts 106 that are substantially similar for grasping the exercise bar 100 with both hands of a lifter. In other embodiments, the exercise bar 100 includes a single adjustable grip mount 106. The illustrated exercise bar 100 includes two locking members 158 for each adjustable grip mount 106 (i.e., which may be referred to as first, second, third, and fourth locking members) with the locking members 158 engaging with a separate rail 104 (which may be referred to as first and second rails). In other embodiments, a single locking member 158 may be used to lock the adjustable grip mount 106 (e.g., the exercise bar 100 includes a single rail 104).

Referring now to FIGS. 10-21, another example adjustable grip mount of the present disclosure for gripping an exercise bar 508 is indicated generally as "500". The adjustable grip mount 500 generally does not include the exercise bar 508; however, the exercise bar 508 is shown to illustrate use of the adjustable grip mount 500. While a pair of adjustable grip mounts 500 may be referenced herein and shown in the Figures (which may be referred to as first and second adjustable grip mounts), the present disclosure should not be considered to require a pair of adjustable grip mounts 500 unless stated otherwise. The pair of adjustable grip mounts 500 may be identical and include the same components.

Generally, the adjustable grip mount 500 may be used with any exercise bar 508 used to lift or pull weights. As noted above, the term "exercise bar" should generally be construed broadly to include any apparatus which can be used to lift or pull weights, including and without limitation, barbells, weight bars, weightlifting bars, rowing pull bars, pullup bars, and pull down bars, and the like.

The example exercise bar 508 shown in FIGS. 10-21 includes exercise bar outer ends 510 and an exercise bar longitudinal axis $A_{508}$ extending between the exercise bar outer ends 510. The exercise bar 508 includes a pair of loading members 516 and a center shaft 520 having shaft outer ends 522. The exercise bar 508 includes a collar 518 disposed between each of the loading members 516 and the center shaft 520. Each of the loading members 516, the center shaft 520, and each of the collars 518 are substantially cylindrical in shape. In this illustrated embodiment, the collars 518 have a larger diameter than the loading members 516. The collars 518 may act as a stop for barbell weights (not shown) that are loaded on the loading member 516 by a user to selectively adjust the amount of weight carried by the exercise bar 508. The illustrated loading members 516 are example loading member 516 and generally any loading members that are capable of providing weight to the exercise bar 508 may be used unless stated otherwise (including embodiments in which the exercise bar 508 itself is used for training or therapy without weights being added thereto). The loading members 516 may be rigidly fixed to the center shaft 520 and/or the loading members may rotate about the exercise bar longitudinal axis $A_{508}$.

Each adjustable grip mount 500 includes a base 502 (FIG. 11), a handle member 504 configured to rotate relative to the base 502, and a locking member 506. Referring now to FIGS. 12-15, the base 502 includes a top surface 526 and a bottom surface 528 that are circular in shape and substantially parallel to each other. In the illustrated embodiment, the top surface 526 is larger than the bottom surface 528. The top surface 526 includes a lip 532 which extends outward around the perimeter of the top surface 526. The base 502 includes an outer wall 534 that is cylindrical in shape and extends around the top surface 526. The base 502 includes a base chamber 536 for receiving at least a portion of the exercise bar 508 (e.g., receive the center shaft 520). The base chamber 536 includes a rounded portion 540 for receiving the exercise bar 508.

The base 502 includes a recess 546 (e.g., circular recess) disposed within the top surface 526. The recess 546 is defined by a ledge 548 and floor 542. The base 502 further includes at least one base borehole 552 passing through the base 502 from the floor 542 of the recess 546 to the bottom surface 528 of the base 502. In the illustrated embodiment, the base 502 includes a pair of boreholes 552 (FIG. 15) arranged on either side of the base chamber 536. The base 502 further includes a pair of bottom recesses 556 with each recess 556 being concentric with a borehole 552.

The handle member 504 (FIG. 16) includes an annular member 600 and a handle 602 that extends from the annular member 600. The handle 602 includes a shaft portion 630 having a first end 606, a second end 608, and a handle lengthwise axis $X_{602}$ defined therebetween. The handle 602 includes a pair of supports 612. The supports 612 are attached to the annular member 600 and extend outward from the annular member 600 to the shaft portion 630 to distance the shaft portion 630 from the annular member 600. The shaft portion 630 is substantially cylindrical in shape and sized and shaped to be grasped by the hands of a user. The handle 602 includes a rotational axis $Y_{602}$ extending through the center of the annular member 600. The handle lengthwise axis $X_{602}$ and rotational axis $Y_{602}$ are generally perpendicular.

Figure 11:
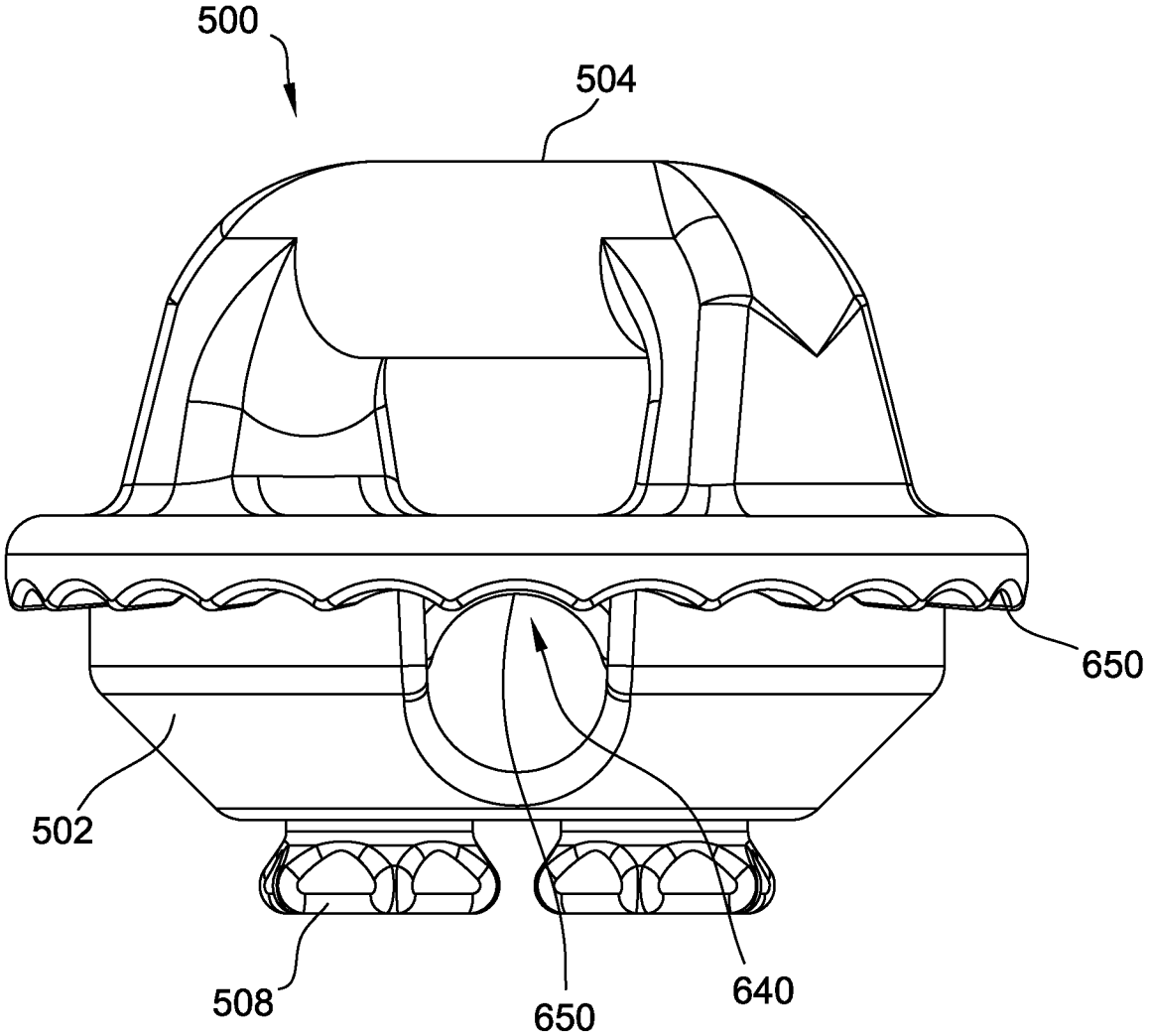
FIG. 11 is a side view of the adjustable grip mount in a locked position.
Figure 12:
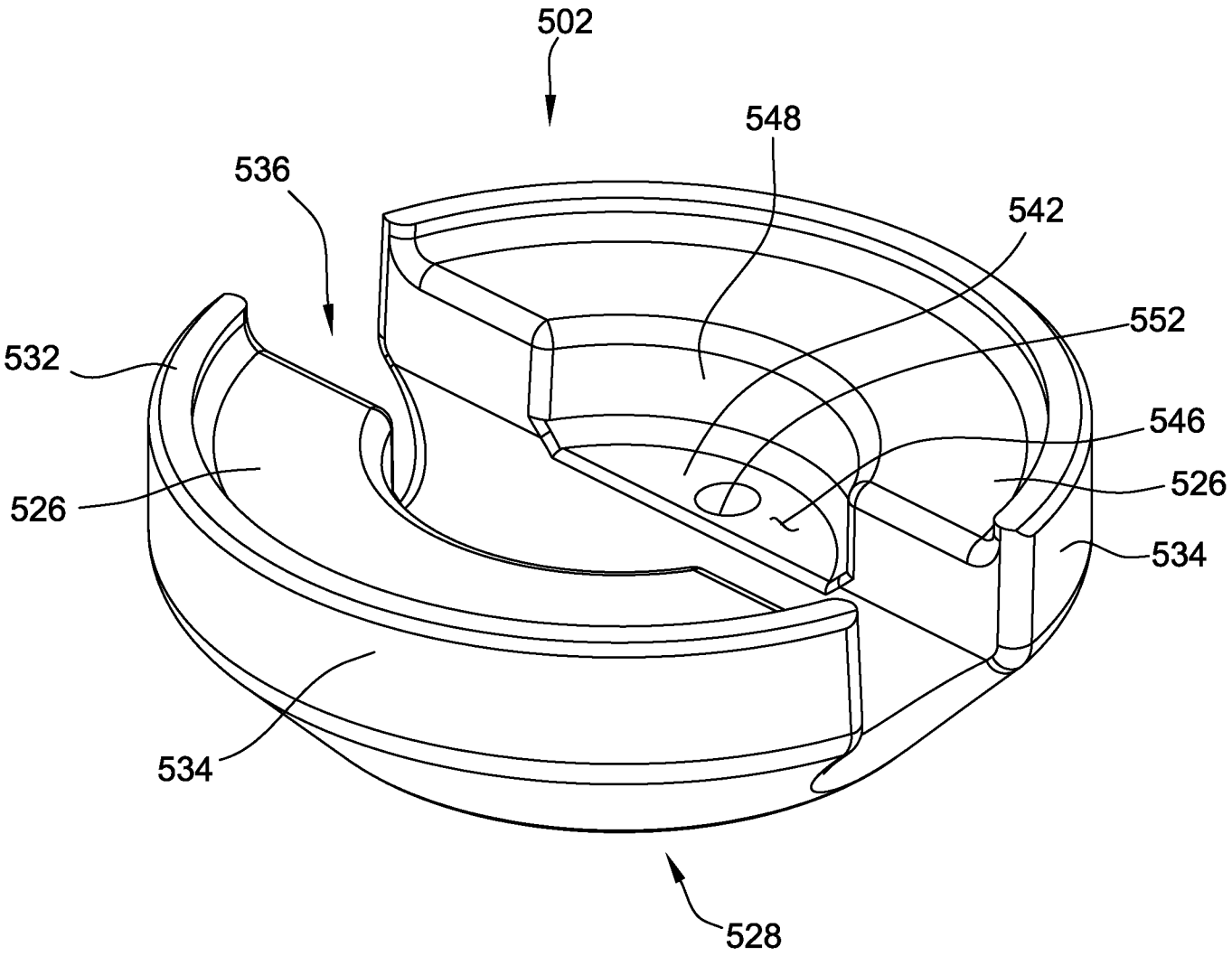
FIG. 12 is a perspective view of a base of the adjustable grip mount.
Figure 13:
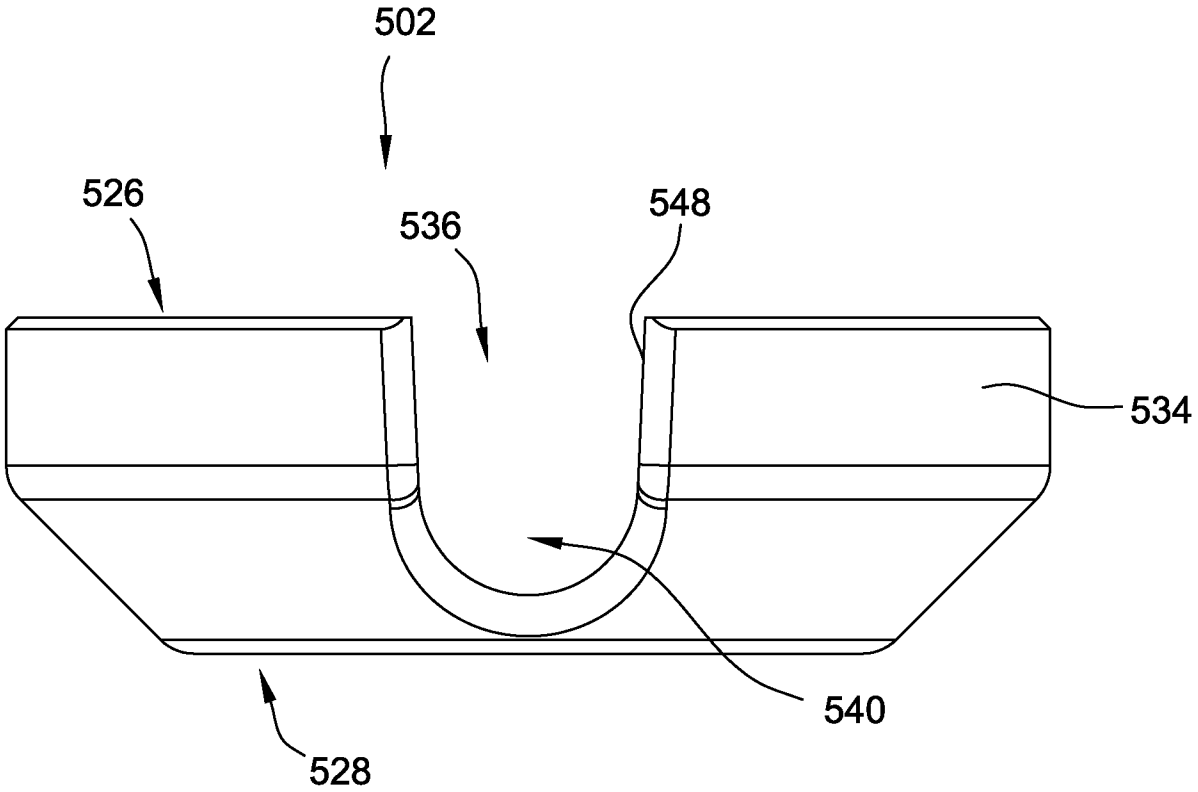
FIG. 13 is a side view of the base.
Figure 14:
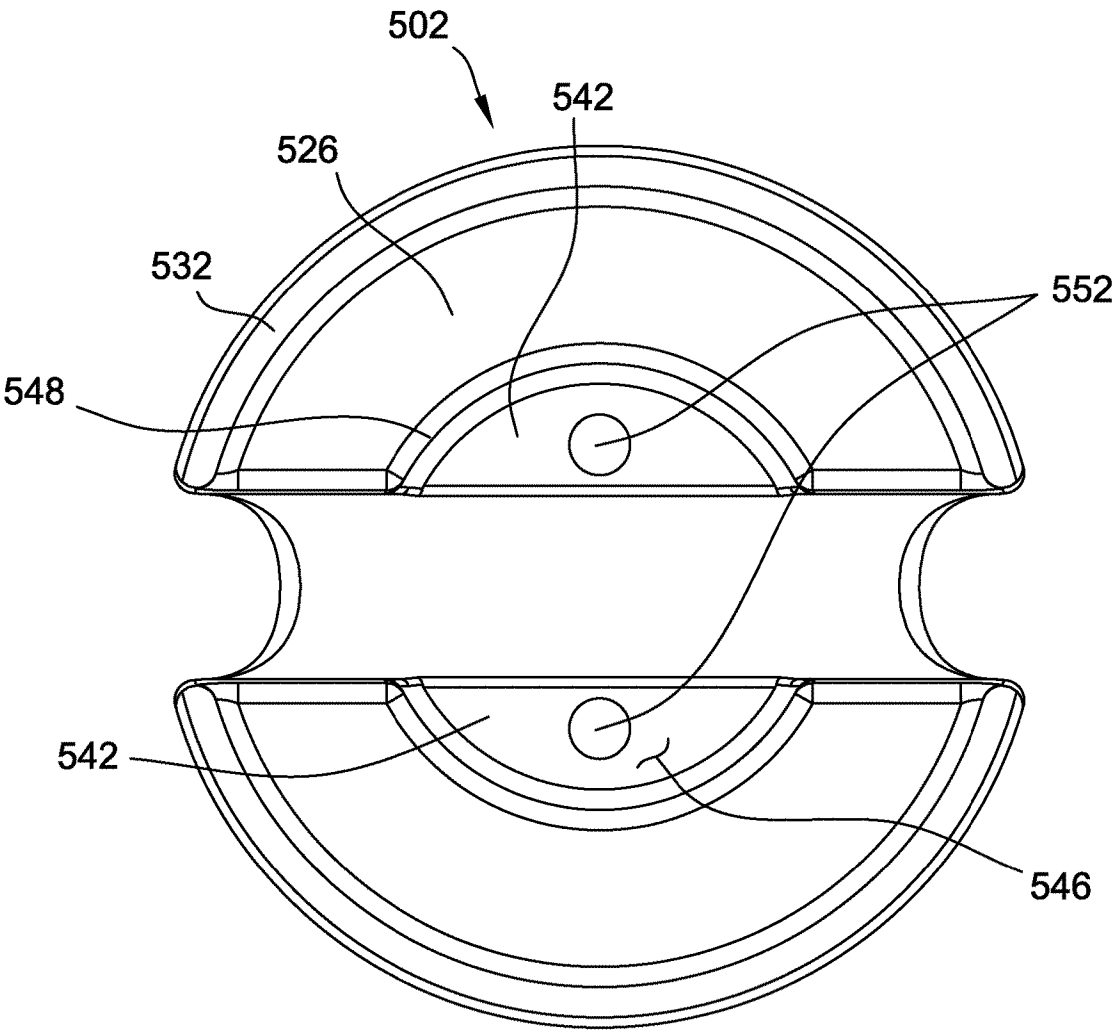
FIG. 14 is a top view of the base.
Figure 15:
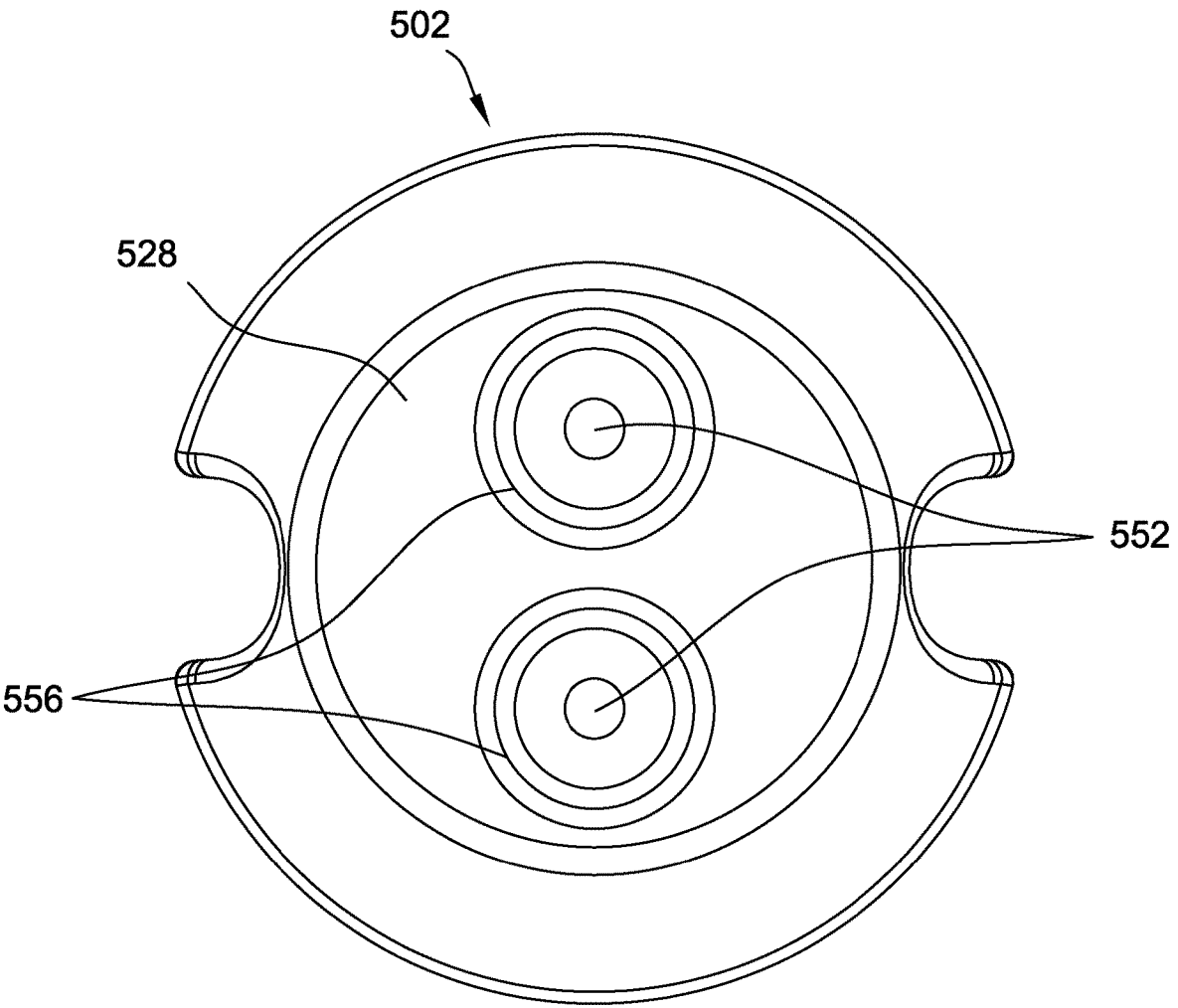
FIG. 15 is a bottom view of the base.
Figure 16:
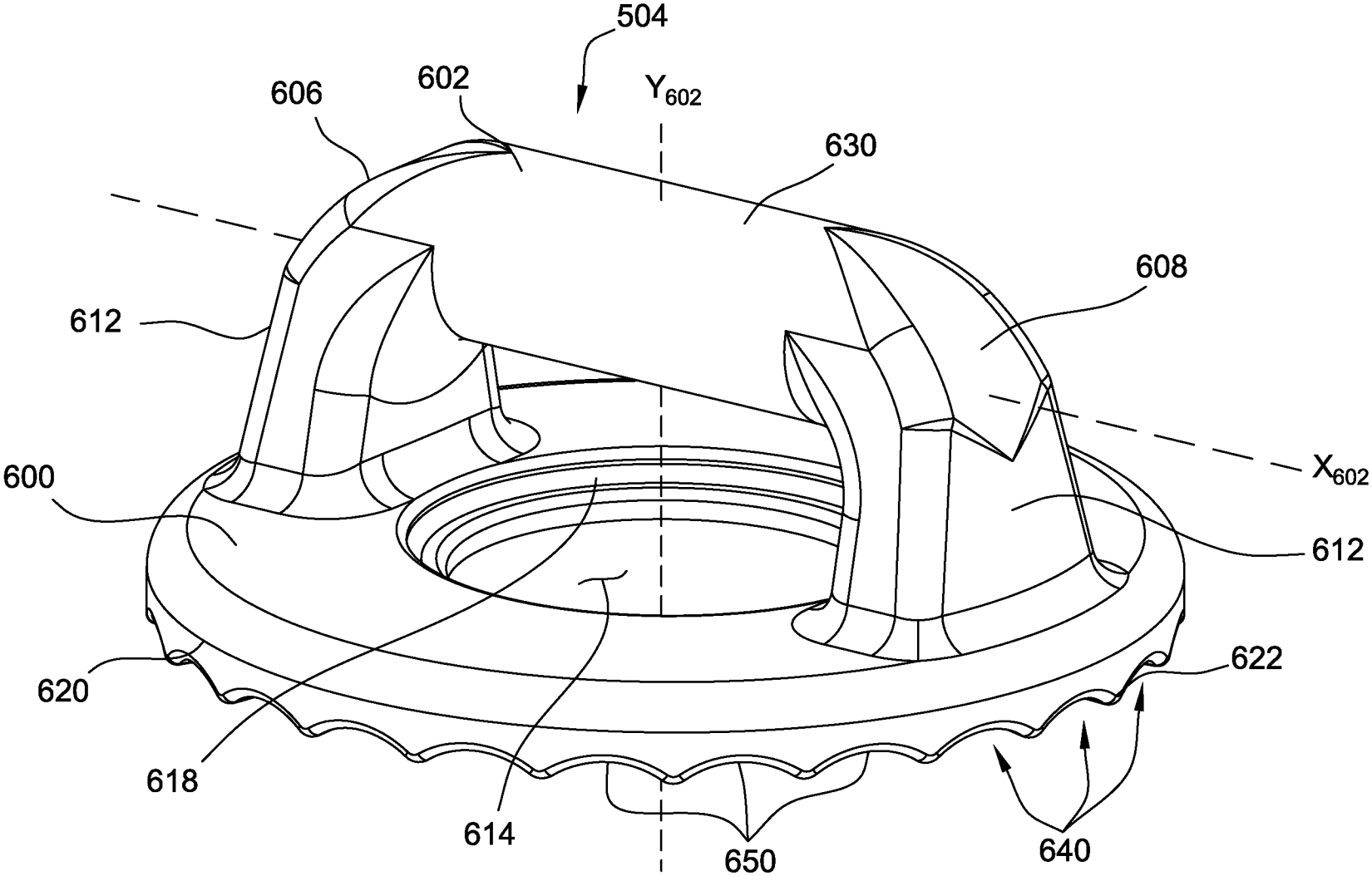
FIG. 16 is a perspective view of a handle member of the adjustable grip mount.
Figure 17:
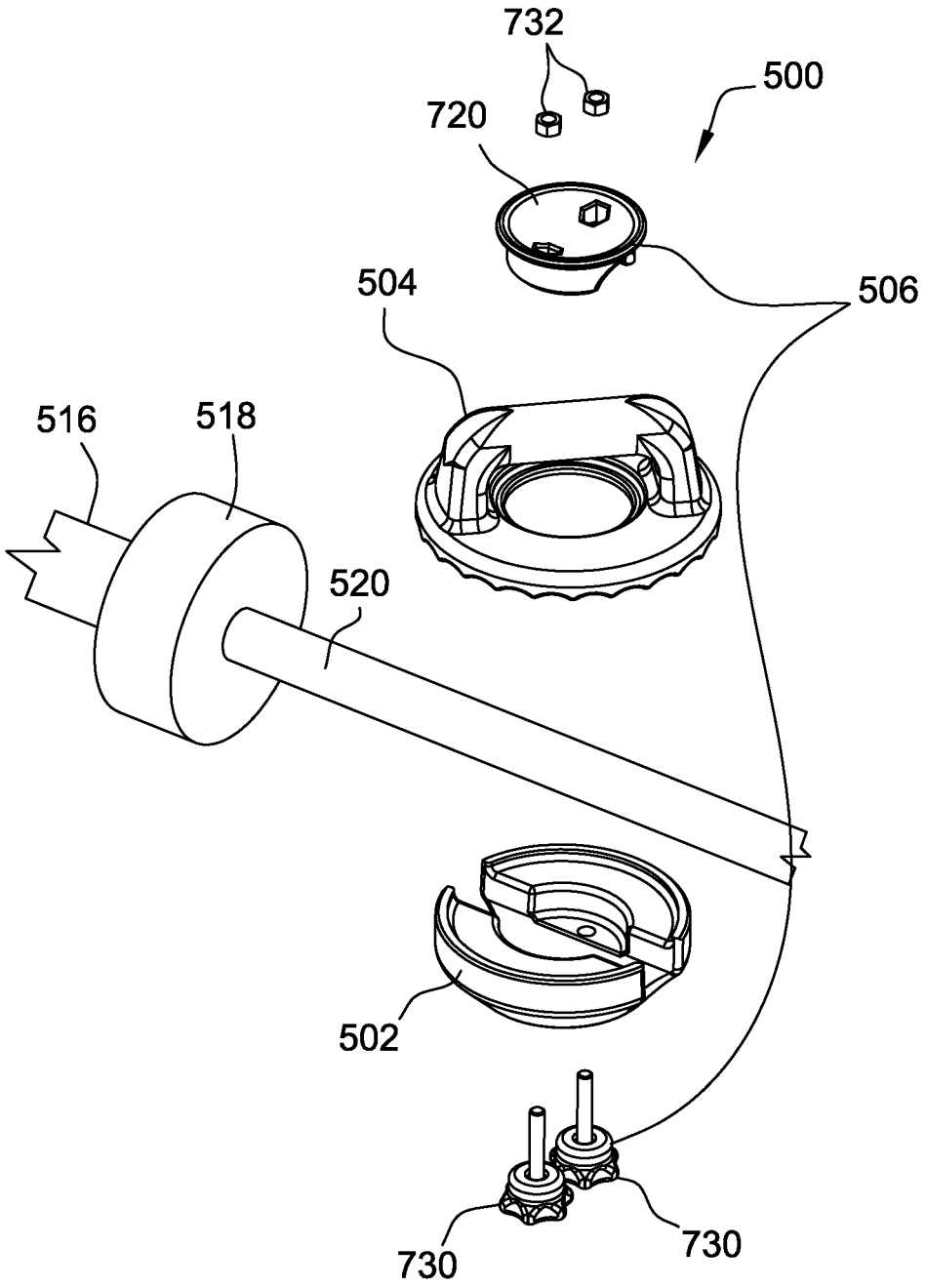
FIG. 17 is perspective exploded view of the adjustable grip mount and the exercise bar.
Figure 18:
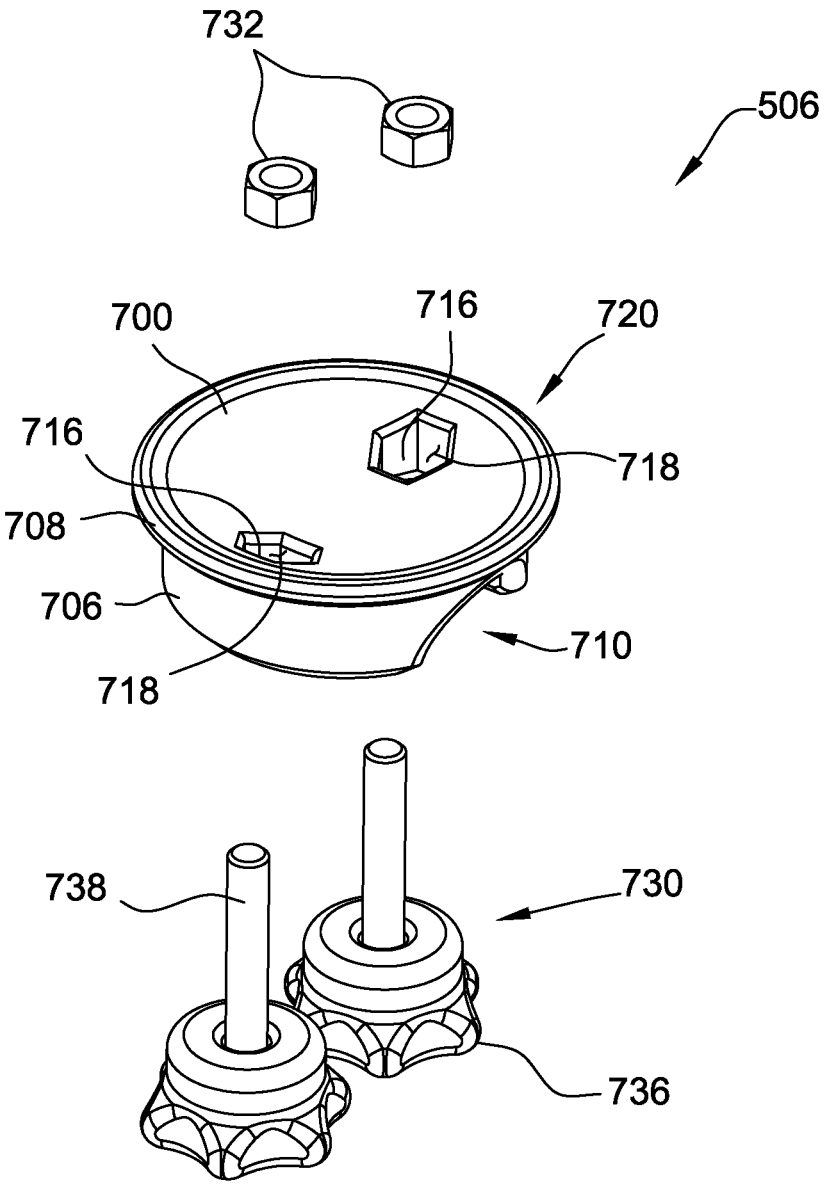
FIG. 18 is an exploded view of a locking member of the adjustable grip mount.
Figure 19:
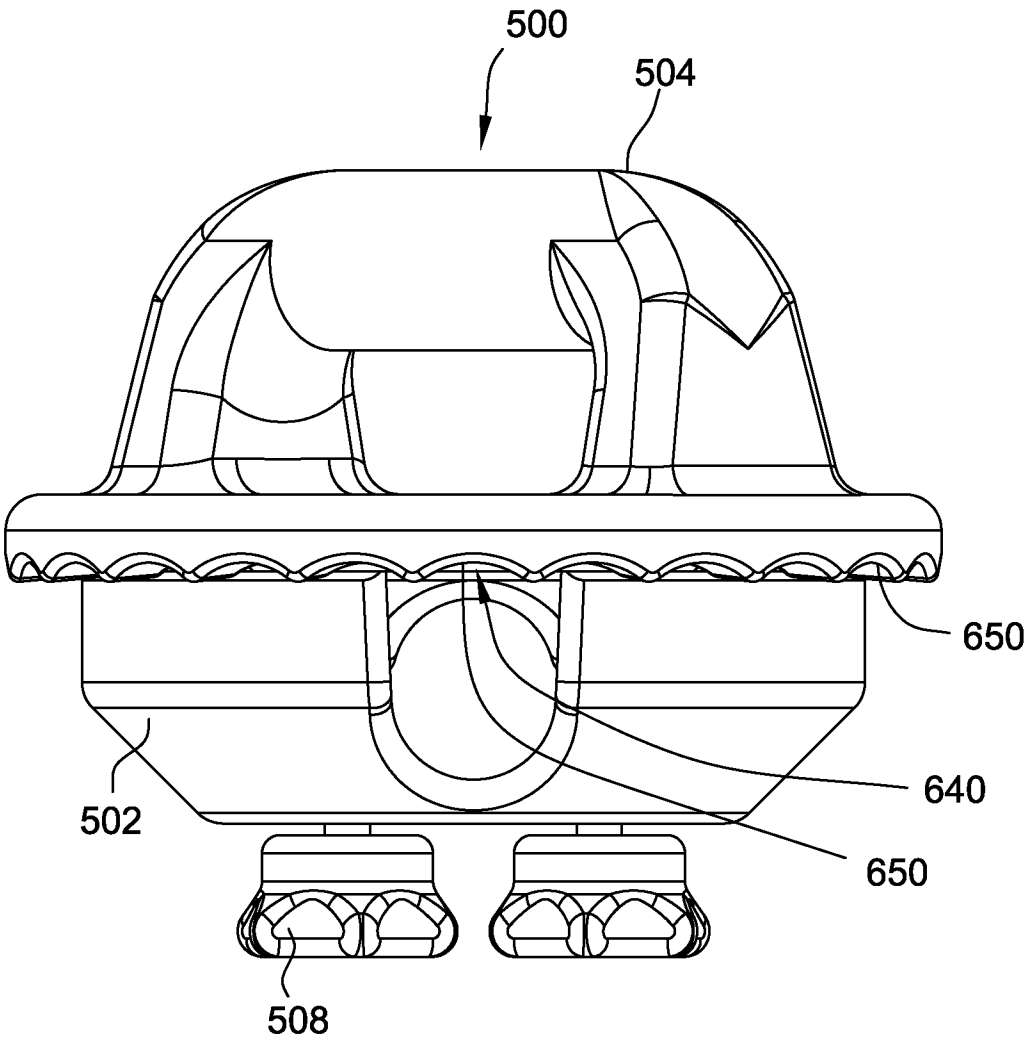
FIG. 19 is a side of the adjustable grip mount in an unlocked position.

The annular member 600 includes a central aperture 614 (FIG. 16) defined by an annular ledge 618. The annular member 600 further includes a wall 620 extending around the perimeter of the annular member 600. The wall 620 includes a scalloped edge 622 having a plurality of indents 640. Each indent 640 is configured to receive at least a portion of the exercise bar 508 and has a contact surface 650 that contacts the exercise bar 508 when the adjustable grip mount is in the locked position (FIG. 11). As further explained below, the indents 640 are rotatable relative to the base 502 when locking member(s) 506 are in the unlocked position (FIG. 19). Generally, each indent 640 is paired with a corresponding indent 640 opposite the indent 640 such that a pair of indents 640 receives at least a portion of the exercise bar 508 when the pair of indents 640 are aligned with the exercise bar 508.

Referring now to FIG. 11, when the adjustable grip mount 500 is in a locked position, the handle member 504 receives at least a portion of the base 502. The wall 620 of the handle member 504 may be in sliding contact with the outer wall 534 of the base 502 to allow the handle member 504 to rotate relative to the base 502 when the adjustable grip mount 500 is the unlocked position (FIG. 19).

The locking member 506 (FIG. 16) includes a body portion 720, one or more thumb screws 730 and one or more lock nuts 732. The body portion 720 includes a locking member chamber 710 sized and shaped to receive a portion of the exercise bar 508 when the adjustable grip mount 500 is in the locked position (FIG. 11). The locking member 506 includes at least one locking borehole 716 extending through the locking member 506. The locking borehole 716 includes a counter sink 718 that receives a locking nut 732 (e.g., is hexagonal in shape).

The body portion 720 includes a cylinder 706 and a lip 708 that extents radially outward from the cylinder 706. The cylinder 706 passes through the central aperture 614 (FIG. 16) of the handle member 504. The lip 708 of the body portion 720 of the locking member 506 rests on the annular ledge 618 of the handle member 504 when the adjustable grip mount 500 is in the locked position. At least a portion of the cylinder 706 is also disposed within the recess 546 of the base 502. When the body portion 720 of the locking member 506 is disposed within the recess 546, the locking boreholes 716 are arranged to align with the base boreholes 552.

The locking member 506 also includes a pair of thumb screws 730 (FIG. 16) and a pair of lock nuts 732. The lock nuts are sized and shaped to fit within the counter sink 718 such that there is contact engagement between the lock nuts 732 and the counter sink 718 preventing the lock nuts 732 from rotating relative to the counter sink 718.

The thumb screw 730 includes a knob 736 and threaded shaft 738. The shaft 738 extends through the boreholes 552 of the base 502 and locking boreholes 716 of the body portion 720 of the locking member 506. The threaded shaft 738 extends into the counter sink 718 such that the locking nut 732 may be threaded onto the shaft 738. The knob 736 is sized and shaped such that it may be easily grasped and rotated by the hands of a user. The knob 736 is also sized and shaped such that when the thumb screw 730 is substantially threaded with the lock nut 732, the knob 736 may be received in the bottom recesses 556 of the base 502.

The locking members 506 include at least two positions—a locked position (FIG. 11) in which the adjustable grip mount 500 is securely fastened to the exercise bar 508 and an unlocked position (FIG. 19) in which the base 502 and handle member 504 may move relative to each other upon actuation of the locking member 506 (i.e., upon turning the thumb screw 730 to decrease distance at which the lock nut 732 is threaded onto the shaft 738). In the locked position, the exercise bar 508 is clamped between the base 502 and the handle member 504 (e.g., with the body portion 720 of the locking member 506 sandwiched between the handle member 504 and the exercise bar 508). In the unlocked position, the handle member 504 may move along the exercise bar 508 relative to the longitudinal axis $A_{508}$ (FIG. 20) of the exercise bar 508 and the handle 602 may rotate relative to the base about the rotational axis $Y_{602}$.

In the locked position, the thumb screw 730 is substantially threaded into the lock nut 732, such that at least a portion of the lock nut 732 and at least a portion of the thumb screw 730 provide a clamping force to the base 502, and the locking member 506, thereby clamping at least a portion of the center shaft 520 disposed within the chamber 536 and the locking member chamber 710. In the locked position, the center shaft 520 is restrained within the chamber 536, locking member chamber 710, and a pair of indents 640, such that movement or rotation relative to the adjustable grip mount 500 is resisted. In the locked position, the annular ledge 618 of the annular member 600 and the lip 708 of the locking member 506 are in contact, such that the handle member 504 is clamped to the base 502 by the locking member 506.

Figure 20:
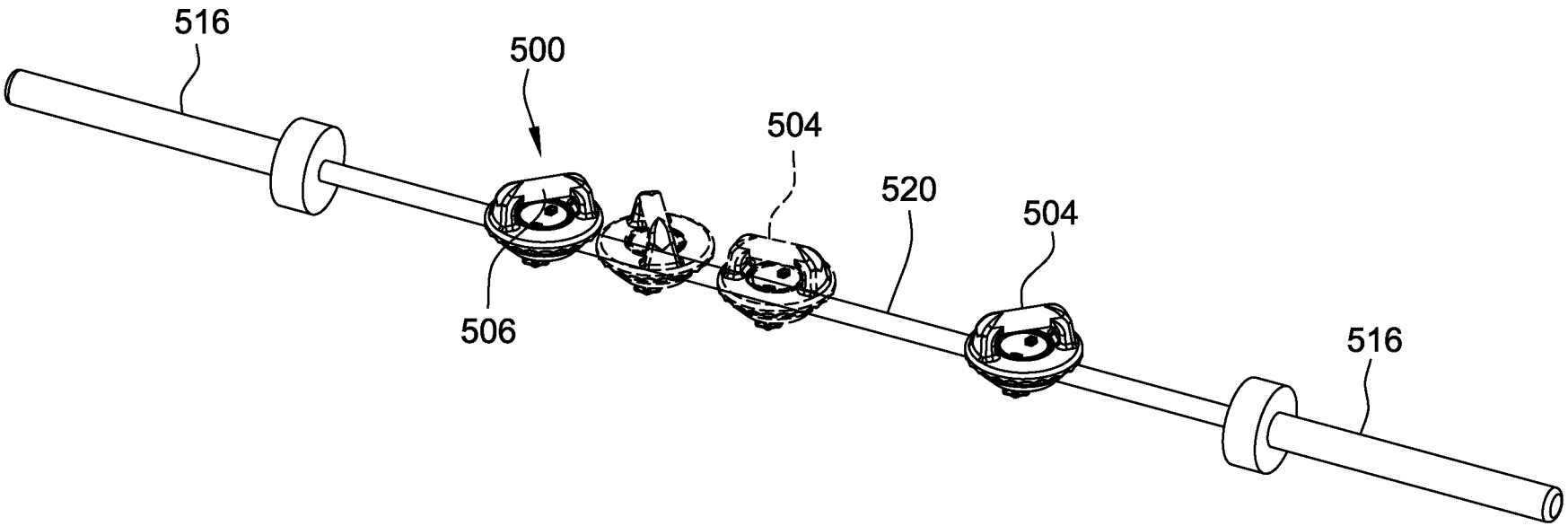
FIG. 20 is a perspective view of a pair of adjustable grip mounts shown in two different positions relative to the exercise bar.

In the unlocked position, the thumb screw 730 is not substantially threaded into the lock nut 732, such that there is sufficient clearance between the center shaft 520, the locking member 506, the handle member 504, and the base 502 to allow for movement between the adjustable grip mount 500 and the center shaft 520 of the exercise bar 508. In the unlocked position, a user may grasp the handle member 504 and apply a push or a pull to translate the adjustable grip mount 500 along the center shaft 520 about the exercise bar axis $A_{508}$ to selectively position the adjustable grip mount 500 along the exercise bar 508 (FIG. 20). Additionally, a user may grasp the handle member 504 and apply a torque, causing the handle member 504 to rotate about the rotational axis $Y_{602}$, around the base 502 and the lock member 506, such that the handle lengthwise axis $X_{602}$ may be arranged in a plurality of angles relative to the exercise bar axis $A_{508}$ (e.g., with the number of positions being the number of pairs of indents 640 opposite one another).

A user may selectively adjust the adjustable grip mount 500 in either one of the locked or the unlocked positions by applying a rotational force to the knob 736 of the thumb screw 730 to either thread or unthread the thumb screw 730 into the lock nut 732.

Figure 21:
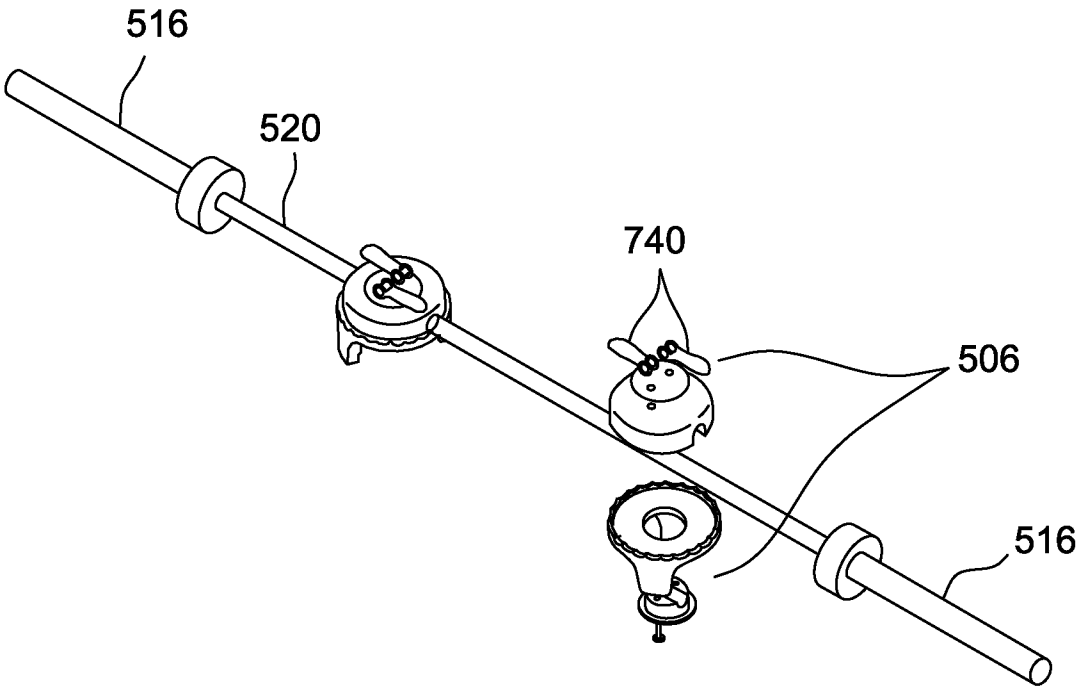
FIG. 21 is a perspective view of an adjustable grip mount with another embodiment of a locking member.

In an alternative embodiment and as shown in FIG. 21, the locking member 506 may include a quick release cam-action clamping fastener 740 (e.g., rather than a thumb screw). The cam fastener 740 may be rotated past its crown to lock the fastener in the locked position. The cam fastener 740 may be rotated in the opposite direction to move the locking member into the unlocked position.

As used herein, the terms "about," "substantially," "essentially" and "approximately" when used in conjunction with ranges of dimensions, concentrations, temperatures or other physical or chemical properties or characteristics is meant to cover variations that may exist in the upper and/or lower limits of the ranges of the properties or characteristics, including, for example, variations resulting from rounding, measurement methodology or other statistical variation.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawing[s] shall be interpreted as illustrative and not in a limiting sense.

What is claimed is:

1. An exercise bar having a longitudinal axis and comprising:

a pair of loading members;

a first rail disposed between the loading members, the first rail including a first slot formed therein that extends along at least a portion of a length of the first rail;

a second rail disposed between the loading members, the second rail including a second slot formed therein that extends along at least a portion of a length of the second rail; and an adjustable grip mount for gripping the exercise bar, the adjustable grip mount comprising:

a handle member that comprises a handle for grasping the adjustable grip mount;

a first locking member that extends through the first slot and connects to the handle member, the first locking member configured to move between a locked position in which the handle member is clamped to the first rail and an unlocked position in which the handle member may move along the first rail relative to the longitudinal axis and in which the handle may rotate about a rotational axis; and a second locking member that extends through the second slot and connects to the handle member, the second locking member configured to move between a locked position in which the handle member is clamped to the second rail and an unlocked position in which the handle member may move along the second rail relative to the longitudinal axis and in which the handle may rotate about the rotational axis.

2. The exercise bar as set forth in claim 1 wherein the adjustable grip mount is a first adjustable grip mount and the handle is a first handle, the exercise bar further comprising:

a second adjustable grip mount for gripping the exercise bar, the second adjustable grip mount comprising:

a second handle member that comprises a second handle for grasping the adjustable grip mount;

a third locking member that connects to the second handle member, the third locking member configured to move between a locked position in which the second handle member is clamped to the first rail and an unlocked position in which the second handle member may move along the first rail relative to the longitudinal axis and in which the second handle may rotate about a second rotational axis; and a fourth locking member that connects to the second handle member, the fourth locking member configured to move between a locked position in which the second handle member is clamped to the second rail and an unlocked position in which the second handle member may move along the second rail relative to the longitudinal axis and in which the second handle may rotate about the second rotational axis.

3. The exercise bar as set forth in claim 1 wherein the first and second locking members each includes a thumb screw.

4. The exercise bar as set forth in claim 1 wherein the handle member is cylindrical.

5. An exercise bar having a longitudinal axis and comprising:

a pair of loading members;

a rail disposed between the loading members, the rail including a slot formed therein that extends along at least a portion of a length of the rail;

an adjustable grip mount for gripping the exercise bar, the adjustable grip mount comprising:

a cylindrical handle member that comprises a handle for grasping the adjustable grip mount, a first ring, a second ring, and a raceway formed between the first ring and second ring; and a locking member that extends through the raceway and through the slot and that connects to the handle member, the locking member configured to move between a locked position in which the handle member is clamped to the rail and an unlocked position in which the handle member may move along the rail relative to the longitudinal axis and in which the handle may rotate about a rotational axis.

6. The exercise bar as set forth in claim 5 wherein the locking member includes a screw and a lock nut, the lock nut being disposed within the first and second rings, the screw extending through the raceway and connecting to the lock nut.

7. The exercise bar as set forth in claim 5 comprising a slide member disposed between the rail and the handle member; the rail, slide member, and handle member being clamped together in the locked position, the slide member being capable of sliding along the rail in the unlocked position.

8. The exercise bar as set forth in claim 5 wherein the adjustable grip mount is a first adjustable grip mount, the exercise bar comprising a second adjustable grip mount for gripping the exercise bar, the first and second adjustable grip mounts each comprising:

a cylindrical handle member that comprises a handle for grasping the second adjustable grip mount, a first ring, a second ring, and a raceway formed between the first ring and second ring; and a locking member that extends through the raceway and through the slot and that connects to the handle member, the locking member configured to move between a locked position in which the handle member is clamped to the rail and an unlocked position in which the handle member may move along the rail relative to the longitudinal axis and in which the handle may rotate about a rotational axis.

9. A system for gripping an exercise bar having a longitudinal axis, the system comprising:

a first adjustable grip mount for gripping the exercise bar, the first adjustable grip mount comprising:

a first handle member that comprises a first handle for grasping the first adjustable grip mount, the first handle having a first rotational axis; and a first locking member that is movable between a locked position in which the first adjustable grip mount is fixed relative to the longitudinal axis and the first handle is fixed relative to the first rotational axis and an unlocked position in which at least a portion of the first adjustable grip mount is movable relative to the longitudinal axis and in which the first handle may rotate about the first rotational axis; and a second adjustable grip mount for gripping the exercise bar, the second adjustable grip mount comprising:

a second handle member that comprises a second handle for grasping the second adjustable grip mount, the second handle having a second rotational axis; and a second locking member that is movable between a locked position in which the second adjustable grip mount is fixed relative to the longitudinal axis and the second handle is fixed relative to the second rotational axis and an unlocked position in which at least a portion of the second adjustable grip mount is movable relative to the longitudinal axis and in which the second handle may rotate about the second rotational axis.

10. The system as set forth in claim 9 wherein the system comprises the exercise bar.

11. The system as set forth in claim 9 wherein the locking members are configured to be moved between the locked position and the unlocked position by hand.

* * * * *